United States Patent [19]

Maroney

[11] Patent Number: 4,561,546

[45] Date of Patent: Dec. 31, 1985

[54] SEEDLING GRADING MACHINE

[75] Inventor: William H. Maroney, Suttons Bay, Mich.

[73] Assignee: Marion Van Slooten, West Olive, Mich. ; a part interest

[21] Appl. No.: 320,220

[22] Filed: Nov. 12, 1981

[51] Int. Cl.[4] ..... B07C 5/10

[52] U.S. Cl. ..... 209/586; 198/728; 209/518; 209/551; 209/917

[58] Field of Search ..... 209/586, 518, 587, 551, 209/917, 604, 657, 521; 250/223 R; 198/728, 733

[56] References Cited

U.S. PATENT DOCUMENTS

| | | | |
|---|---|---|---|
| 2,033,645 | 3/1936 | Parkhill . | |
| 2,085,671 | 6/1937 | Powers . | |
| 2,433,946 | 1/1948 | Gause et al. . | |
| 2,791,329 | 5/1957 | Schwartz . | |
| 3,282,419 | 11/1966 | Rock, Jr. . | |
| 3,327,850 | 6/1967 | Simmons . | |
| 3,365,699 | 1/1968 | Foster . | |
| 3,380,460 | 4/1968 | Fuis, Jr. et al. | 209/586 X |
| 3,401,796 | 9/1968 | Hagiz | 209/586 X |
| 3,428,817 | 2/1969 | Hofmeister et al. . | |
| 3,451,547 | 6/1969 | Greller . | |
| 3,566,135 | 2/1971 | Mouchart | 250/219 |
| 3,647,063 | 3/1972 | Rowley | 209/74 |
| 3,653,506 | 4/1972 | Turner et al. | 209/518 |
| 3,659,709 | 5/1972 | Bartlett, Jr. et al. | 209/82 |
| 3,743,092 | 7/1973 | Levinstein | 209/586 |
| 3,834,531 | 9/1974 | Bollerup | 209/74 |
| 4,019,624 | 4/1977 | Torres | 198/728 |
| 4,120,403 | 10/1978 | Stephanos | 209/564 |
| 4,130,480 | 12/1978 | Loewenthal | 209/551 |

FOREIGN PATENT DOCUMENTS

| | | | |
|---|---|---|---|
| 893049 | 4/1962 | United Kingdom | 209/586 |

*Primary Examiner*—Robert B. Reeves
*Assistant Examiner*—Donald T. Hajec
*Attorney, Agent, or Firm*—John A. Waters

[57] ABSTRACT

A seedling grading machine for sorting and collecting seedling trees according to size comprises a conveyor including a longitudinal grate and carrier rods that extend through the grate for moving the seedlings sideways along the grate; an electronic photocell control for measuring the height of each seedling at a front portion of the grate; a series of longitudinally separated gates positioned downstream of the photocell control, each gate corresponding to a given size classification of seedling and opening downwardly to drop the seedling through the gate in accordance with the measured height of the seedling; a dumpable bin in position below each gate to collect the seedlings; an electronic counting means for counting the number of seedlings deposited in each collector bin; a dumping mechanism for dumping each collector bin after a predetermined number of seedlings have been deposited therein; and a conveyor for conveying the seedlings dumped from the collector bin to a packaging station. The gates can be opened by electronic controls actuated by the photocell control or they can be actuated by a detent pin and limit switch mechanism operated by the movement of the conveyor.

3 Claims, 10 Drawing Figures

SEEDLING GRADING MACHINE

FIELD OF THE INVENTION

This invention relates to a seedling grading machine for automatically sorting and collecting seedling trees by size, by means of a photocell measuring device.

BACKGROUND OF THE INVENTION

In the nursery industry, where large quantities of seedlings are grown, a great deal of time is spent in grading seedlings by size. The size of the seedling is an important factor in its value and is often a prerequisite for planting the seedlings by automated equipment. At the present time, seedlings are graded manually by visual measurement of the height of the seedling against a scale or rule and then depositing the seedling in a group according to size designation. This method is slow and involves considerable time and expense in manual labor.

A number of devices have been developed for automatically sorting and collecting various types of objects according to size so as to avoid the problems of manual sorting. Some of these employ photocell devices. However, most of these apparatus are designed to handle one specific type of product and are not adaptable or usable in the nursery industry to sort and collect seedling trees.

It is a primary object of the invention to develop a seedling grading machine for automatically sorting and collecting seedling trees according to size.

SUMMARY OF THE INVENTION

In accordance with the present invention, a seedling grading machine for sorting and collecting seedling trees according to size comprises conveyor means for conveying the seedlings one at a time along a predetermined path in aligned position; electronic photocell control means positioned adjacent the conveyor means for measuring the height of each seedling as it is conveyed along the path; a plurality of separated gates positioned along the conveyor means downstream of the photocell control means, each gate opening downwardly to let any seedling positioned on the gate drop downwardly through the conveyor, each gate corresponding to a given seedling size classification and being selectably actuated by the photocell control means in accordance with the measured height of each seedling, the photocell control means opening the gate corresponding to the measured height of each seedling as the seedling passes over the appropriate gate; and collector means for separately collecting seedlings dropped through each gate.

The collector means comprises a dumpable collector bin positioned under each gate to collect seedlings dropped through the gate; electronic counting means for counting the number of seedlings deposited in each collector bin; and dumping means for dumping the bin and then returning the bin to its collecting position when a predetermined number of seedlings is collected in the bin.

The conveyor mechanism of the present invention comprises a longitudinally oriented grate formed of a plurality of spaced parallel bars. The seedlings are positioned transversely across the bars for movement in a sideways direction from a front to a rear end of the grate. The gates are spaced longitudinally along a rear portion of the grate, and the photocell control mechanism is positioned above the grate at the front portion thereof.

A lower carrier mechanism is positioned below the front portion of the grate for moving the seedlings one at a time along the grate. The lower carrier mechanism comprises a movable lower conveyor positioned below the grate, with a plurality of spaced carrier rods extending upwardly from the lower conveyor through the grate to engage the seedlings laying on the grate. The carrier rods are formed in transverse sets that maintain each seedling in transverse alignment as it is moved along the grate. The individual sets are separated equal distances along the conveyor, such that each set conveys one seedling along the grate in a predetermined sequence.

The lower carrier mechanism mates with an upper carrier mechanism formed of a similar type of conveyor and carrier rod assembly positioned above the grate at the rear portion thereof. The upper carrier rods extend downwardly to the grate so that they take over for the lower carrier rods and continue to slide the trees in transverse alignment along the grate. When the seedlings reach the appropriate gate in the grate, the gate is opened and the seedling drops downwardly to a collector bin below the grate.

The photocell control mechanism comprises a plurality of photocells positioned at different height positions along the grate, with five (5) cells preferably being used. The control mechanism is designed so that when a seedling interrupts only one photocell signal, a first gate opens. When a seedling interrupts two (2) photocells, a second gate opens, and so on. When a seedling fails to open any photocells, the seedling is discharged at the end of the grate.

The photocell control mechanism may be purely electronic such that a programmable controller causes the appropriate gate to open after the seedling has moved a predetermined distance along the conveyor to the appropriate gate. Alternatively, the photocell control can immediately activate a gate actuating device that travels with the moving carrier mechanism and actuates a gate opening switch at the gate through which the seedling is to be dropped.

Seedlings dropped through each gate are collected in a separate collector bin, and an electronic counter monitors the number of seedlings in each bin. When a predetermined number is reached, the bin is automatically dumped onto a conveyor moving below the conveyor bins. The collected seedlings are moved by the conveyor to an appropriate work station for packaging and shipping the seedlings.

These and other features and advantages of the present invention will become apparent from a detailed description of a preferred embodiment of the present invention, which is set forth below.

DETAILED DESCRIPTION OF PREFERRED EMBODIMENTS

Figure 1A:
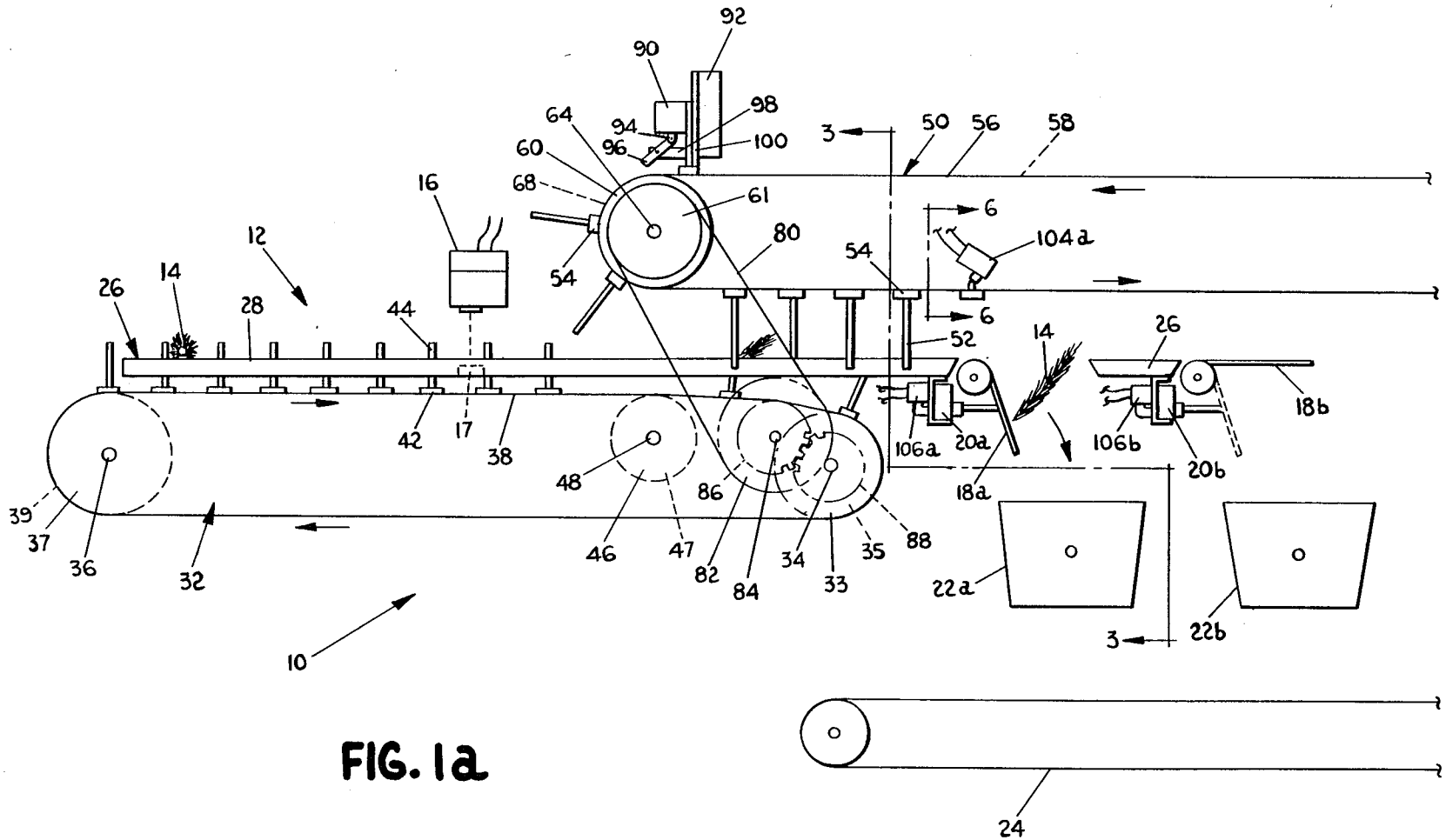
FIGS. 1*a* and 1*b* represent a partial side elevational schematic view of the seedling grading machine of the present invention, with FIG. 1*a* representing a front portion of the machine and FIG. 1*b* representing the rear portion of the machine.
Figure 1B:
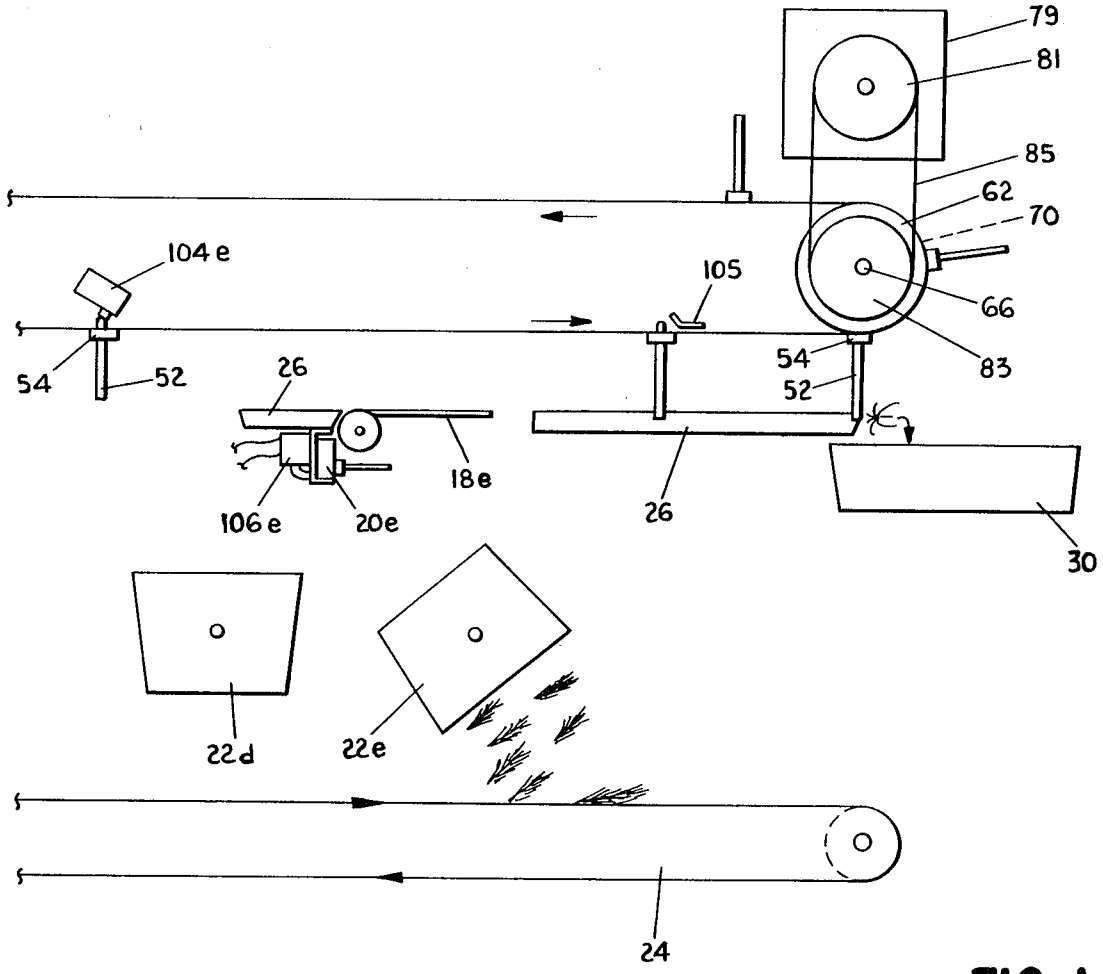

Referring now to the drawings, a general schematic of a seedling grading machine 10 constructed in accordance with the present invention is shown in FIGS. 1*a* and 1*b*.

In its broad aspects, seedling grading machine 10 comprises a generally horizontal conveyor 12 for conveying seedlings 14 along a predetermined path. The seedlings are conveyed passed a photocell control device 16, wherein a control signal representative of the height of each seedling is generated. After the height of each seedling 14 is sensed by photocell control 16, the seedling continues to be conveyed along the path until it comes to an appropriate gate 18 representative of the height classification of that particular size of seedling. At that point, the photocell control signal causes the actuation of a solenoid or, preferably, a solenoid actuated air cylinder 20 to open the gate and drop the seedling downwardly through the bottom of the conveyor. The seedling then drops into a dumpable collector bin 22. An electronic counting device 106 counts the number of seedlings deposited in each bin, and when a predetermined number has been counted, the bin is pivoted or dumped as shown in FIG. 1*b*, so that the seedlings are deposited on a lower conveyor 24. These seedlings are then conveyed to a work station, where they are packaged for shipment, with each package including a predetermined number of seedlings of a particular size category.

Figure 2:
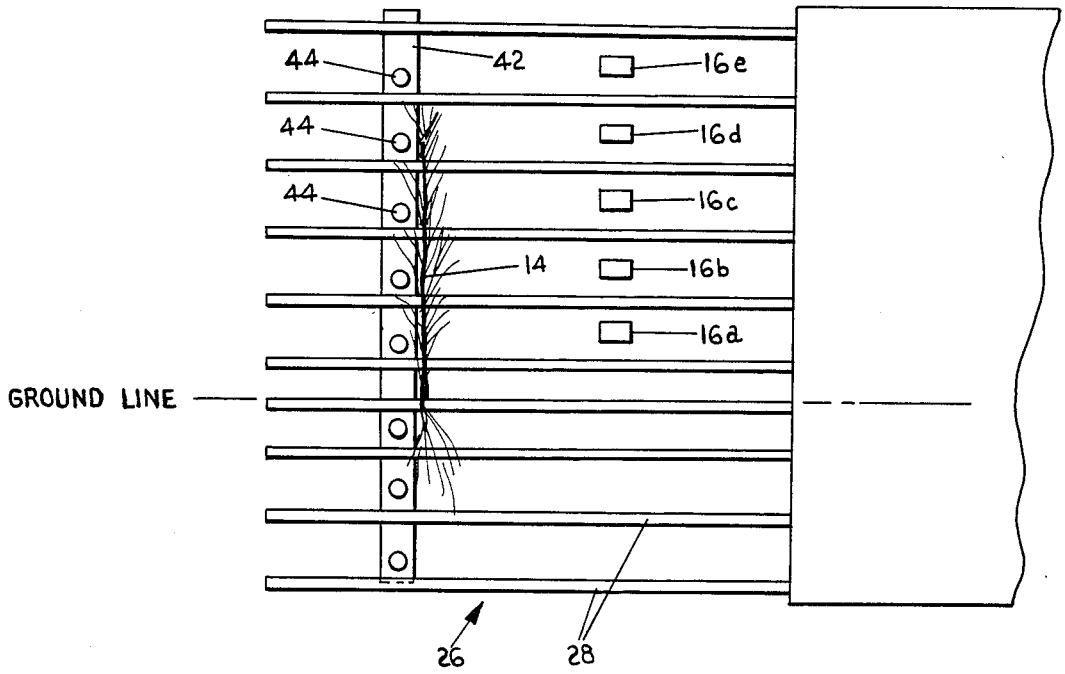
FIG. 2 is a schematic top plan view of the front portion of the seedling grading machine of the present invention, showing the layout of the photocell control mechanism and the manner in which seedlings are positioned on the grate.
Figure 3:
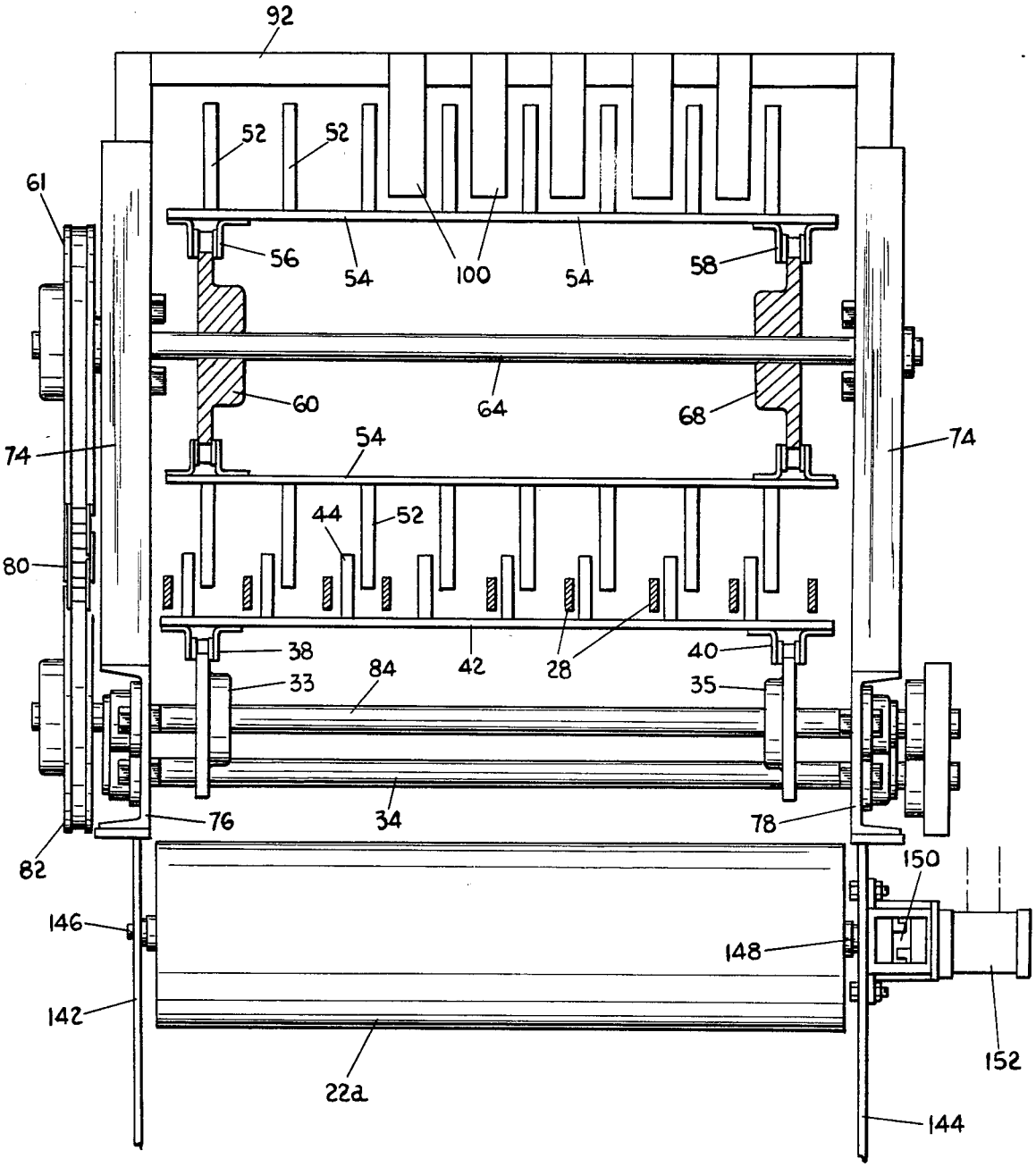
FIG. 3 is a sectional view taken along lines 3—3 of FIG. 1*a*, with some components being removed for clarity.

The conveyor assembly 12 of the present invention comprises a conveyor bed in the form of a longitudinal grate 26 formed of spaced parallel bars 28 (see FIGS. 2 and 3). Each seedling 14 is placed transversely on the grate and is moved along the grate in a sideways direction from the left hand or front end of the conveyor (FIG. 1 orientation) to the right hand or rear end of the conveyor (FIG. 1 orientation).

As shown in FIG. 2, the bars of the grate are, for the most part, spaced equally along the surface of the conveyor, with the exception that two (2) central bars are closer together to accommodate very short seedlings. One of the closely spaced bars is representative of the "ground line" of the seedling, and the seedlings are placed on the grate so that the junction between the stems and the roots of the seedlings fall right on the ground line.

In the preferred practice of the present invention, five (5) photocell detectors (numbered 16*a*–16*e*) are positioned transversely between the bars of the grate, with each detector comprising a downwardly directed light source and a photocell sensor. Corresponding reflectors 17*a*–*e* are attached to the grate bars below the photocell detectors so that the sensors receive reflected light unless the light path is interrupted by a passing seedling. Other types of photocell devices also could be used.

Each photocell detector corresponds to a gate 18*a*–18*e* downstream in the conveyor line. The photocell control circuit is designed so that if a seedling interrupts only one photocell, the seedling will be dropped into the bin corresponding to the first gate (or gate 18*a*). If two (2) photocells are interrupted, the seedling will be deposited in the second bin (corresponding to gate 18*b*). If none of the photocells are interrupted, the seedling will be conveyed to the end of the conveyor line and deposited in a reject bin 30.

The manner in which the seedlings are conveyed along the grate is an important feature of the present invention. As shown in FIG. 1*a*, the seedlings are moved along a left hand or front portion of the grate by means of a lower conveyor assembly 32. Lower conveyor assembly 32 comprises a drive shaft 34 having chain sprockets 33 and 35 at opposite ends thereof at the front end of the lower conveyor, and a driven shaft 36 having sprockets 37 and 39 at opposite ends thereof is positioned at the front end of the conveyor. Conveyor chains 38 and 40 are suspended between the sprockets at the ends of shafts 34 and 36. These chains are interconnected at spaced intervals along the chains by carrier bars 42. Projections or carrier rods 44 extend upwardly from the carrier bars through the grate to a position above the grate, where they will engage the sides of seedlings 14. The carrier rods are positioned transversely across the carrier bars so that they maintain the seedlings in a transverse position as they are conveyed along the grate. The lower conveyor and carrier bars 42 are positioned below the grate and below reflectors 17, so the lower conveyor does not interrupt the action of the photocell detectors. Idler sprockets 46 and 47 mounted on opposite ends of rotatable shaft 48 maintain tension of the chains and hold the chains in their proper position below the grate.

After the seedling passes the photocell control mechanism, lower conveyor 32 terminates and an upper conveyor 50 commences. Upper conveyor 50 is substantially the same as lower conveyor 32, except that carrier rods 52 extend downwardly from carrier bars 54 to a position wherein the carrier rods will continue to move the seedlings along the grate. As with conveyor 32, carrier bars 54 extend transversely between two conveyor chains 56 and 58. Chain 56 is suspended between a sprocket 60 at the front end of upper conveyor 50 and a sprocket 62 at the rear end of upper conveyor 50. Chain 58 is suspended similarly from sprockets 68 and 70 at the opposite ends of the conveyor, with sprockets 60 and 68 being mounted on rotatable shaft 64 and sprockets 62 and 70 being mounted on shaft 66. Shaft 64 is supported in the apparatus by means of vertical support members 74 and 74, which are in turn mounted on outer rail 76 and 78 of the main frame of the apparatus (see FIG. 3).

As shown in FIG. 1*b*, upper conveyor 50 is driven by a variable speed motor 79, which rotates drive sprockets 81 on the motor and 83 on conveyor shaft 66 by a drive chain 85.

Upper conveyor 50 in turn drives lower conveyor 32 by means of a chain 80 interconnecting a lower sprocket 82 and a drive sprocket 61 on shaft 64 of the upper conveyor. Lower sprocket 82 is rotatably mounted on shaft 84, which is in turn mounted between side rail 76 and 78. Sprocket 82 has an internal gear portion 86 that meshes with an internal gear portion 88 on sprocket 33. Rotation of sprocket 82 by means of the variable speed drive motor 79 thus causes the rotation in timed sequence of lower conveyor 32. The carrier bars of the respective conveyors are spaced equal distances apart and are positioned so that they mate when they come together at the end of the lower conveyor and the beginning of the upper conveyor, thus providing a smooth transition in the carrier rods sliding the seedlings along the conveyor.

Figure 6:
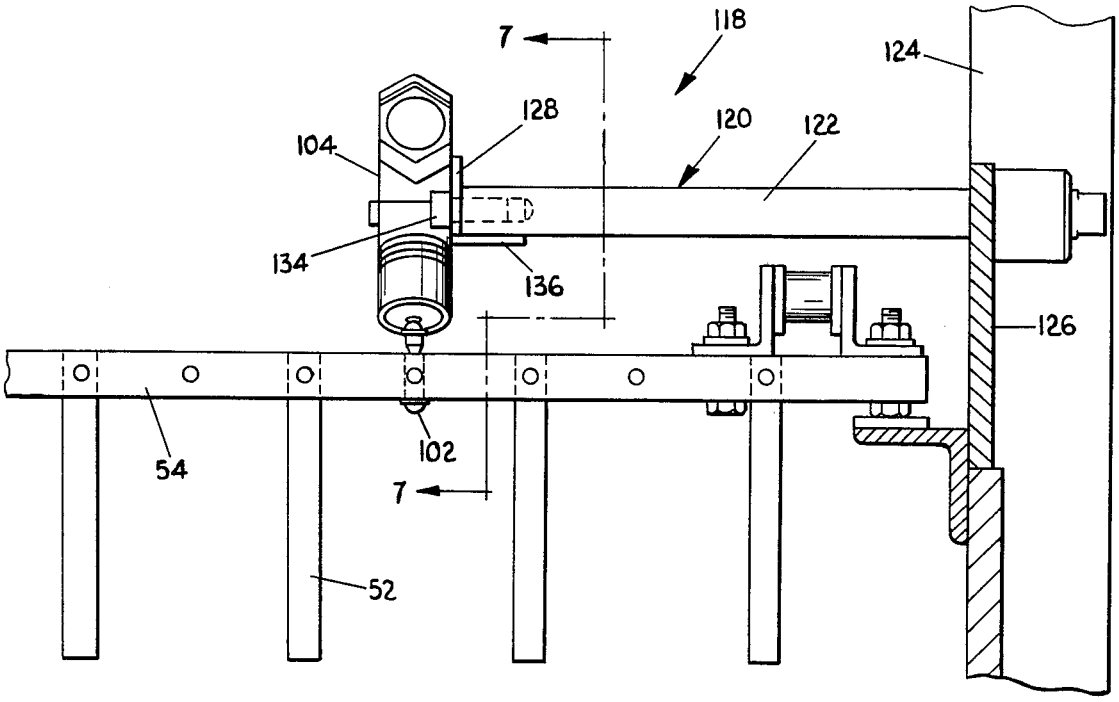
FIG. 6 is a view taken along line 6—6 of FIG. 1*a*.
Figure 7:
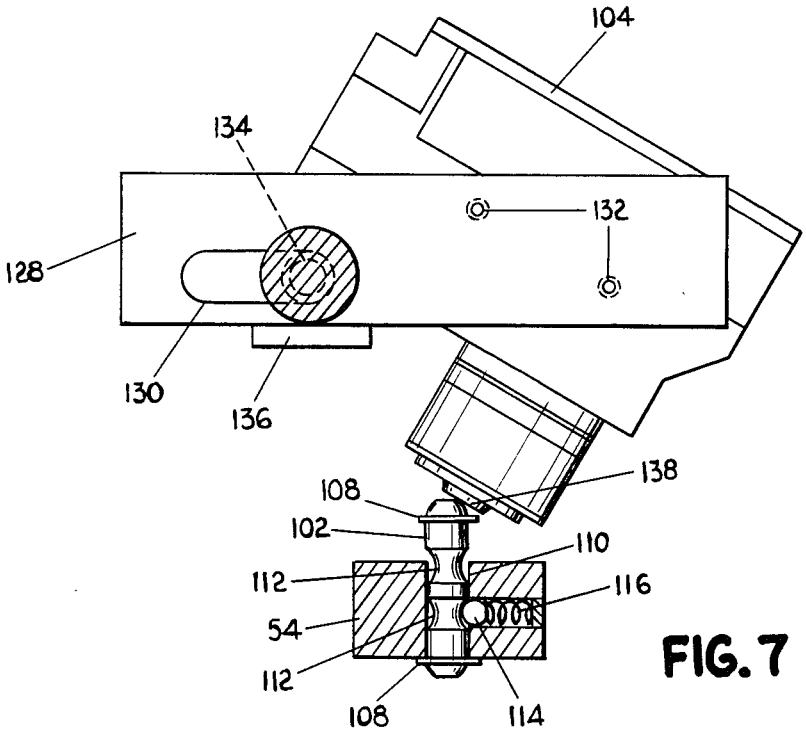
FIG. 7 is a view taken along line 7—7 of FIG. 6.
Figure 8:
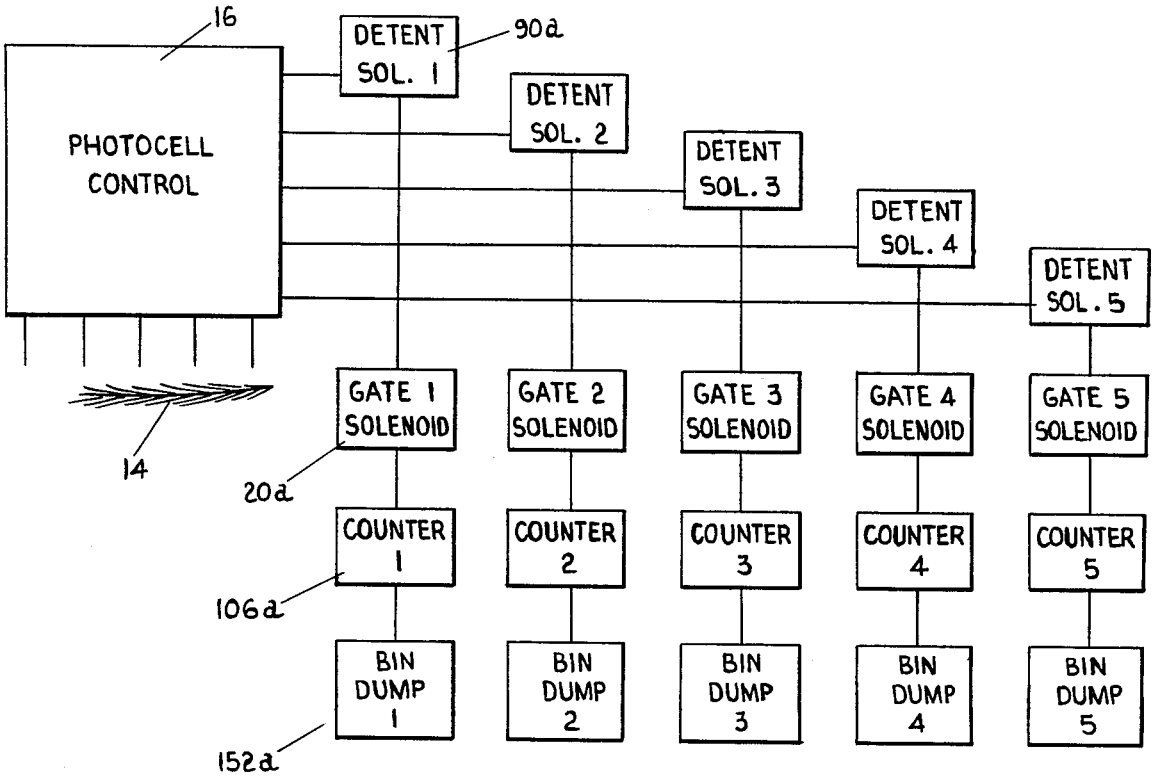
FIG. 8 is an electrical block diagram of the electrical circuit of the present invention.

One means by which photocell control device 16 causes the proper gates to open to deposit the seedlings in an appropriate collector bin is shown in FIGS. 1*a* and 4–7, as well as FIG. 8.

In this embodiment, whenever the photocell control device registers a seedling of a particular size (as indicated by the number of photocells that are interrupted by the seedling), a signal is transmitted to an appropriate trip solenoid 90 mounted on a solenoid bridge arm 92 over the front end of upper conveyor 50. Trip solenoid 90 has an extendible output shaft 94 that is connected to one end of a pivotable actuator lever or trip lever 96, with trip lever 96 being pivotably mounted between its ends by a a shaft 97 on an arm 98 extending outwardly from a bracket 100 on bridge arm 92.

Figure 4:
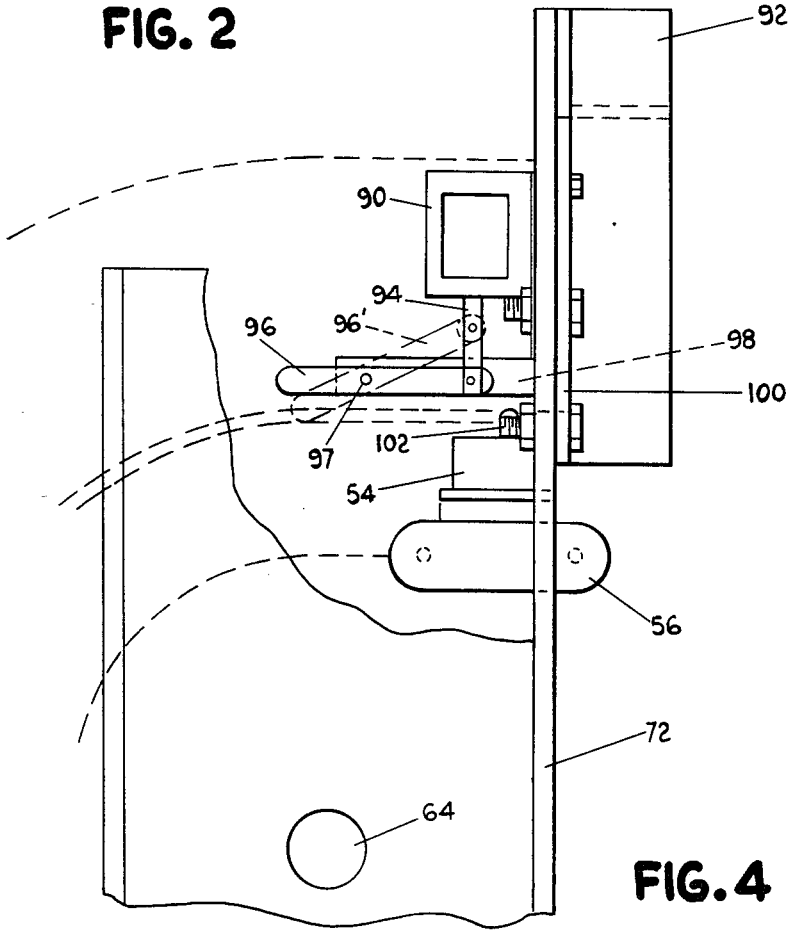
FIG. 4 is a partial side elevational view showing the manner in which detent actuating solenoids are mounted on the top of the machine.

As shown in FIG. 4, when trip solenoid 90 is in its deactivated position, output shaft 94 is extended and trip lever 96 is horizontal, with its outer end raised. When the trip solenoid is activated, the output shaft is retracted and the outer end of the trip lever extends downwardly toward the carrier bar, as shown by phantom FIG. 96′ in FIG. 4.

Figure 5:
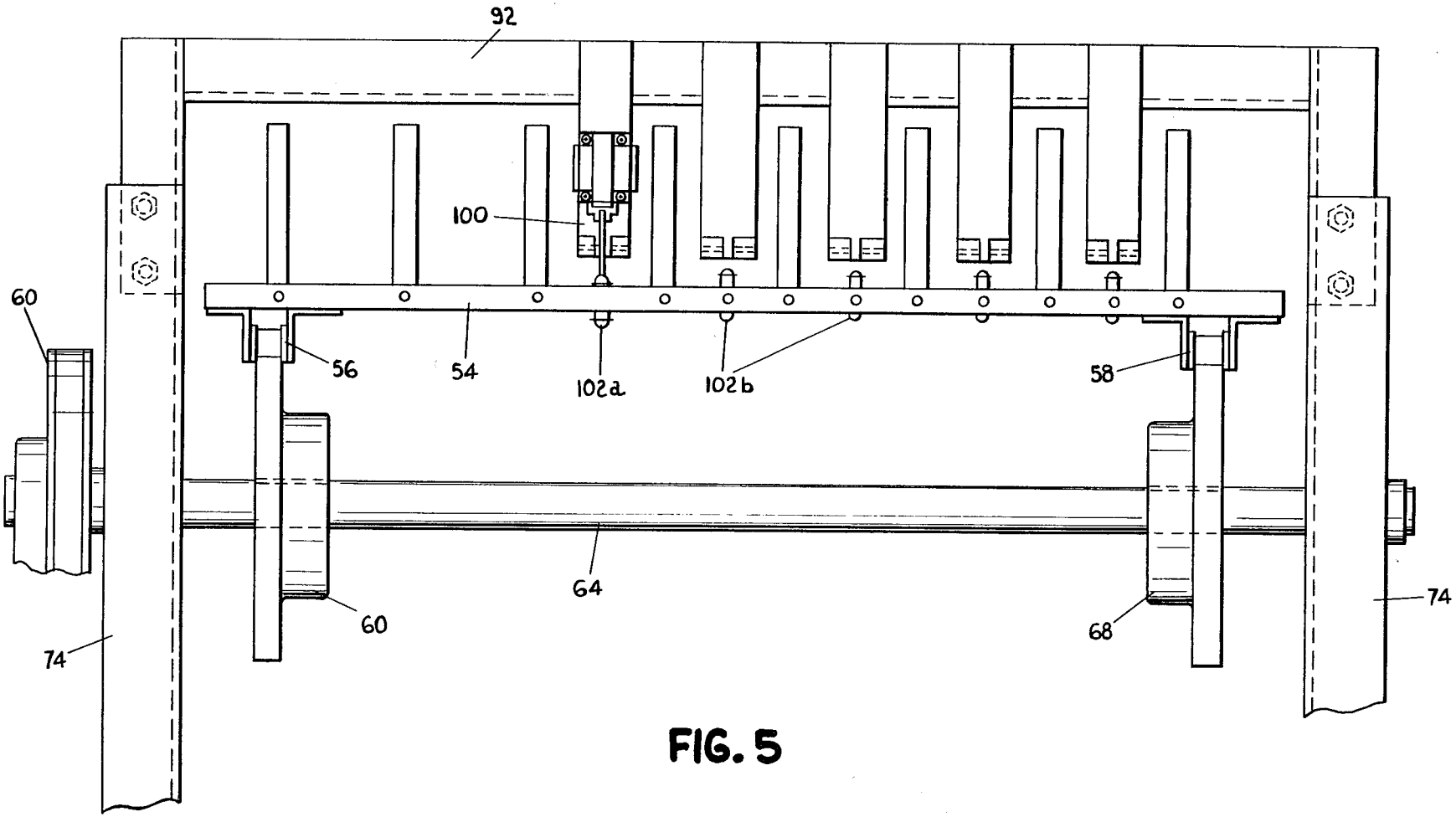
FIG. 5 is a partial front elevational view showing the detent actuating solenoid assembly of FIG. 4.

As shown in FIG. 5, each carrier bar 54 in the upper conveyor assembly is provided with a series of mechanical limit switch actuators in the form of detent pins 102 that are slidably mounted in openings through the carrier bar. The detent pins can be in a raised or deactuated position as indicated by pins 102*b* in FIG. 5 or they can be in a lowered or actuated position as indicated by pin 102*a* in FIG. 5. When a particular trip solenoid has been activated by photocell control 16, trip lever 96 engages the upper end of a detent pin and depresses it to the actuated position shown by pin 102*a*.

The trip solenoids are positioned so that they act on the detent pins in the carrier bar that will mate with the carrier bar of the seedling being measured by the photocell control device when the seedling reaches the end of the lower conveyor. After actuation of a detent pin, the trip solenoid returns to its deactivated position, with the lever positioned so that it does not engage a detent pin.

As the upper conveyor continues to move around sprockets 60 and 68, the upper carrier bars move from the upper to the lower surface of the upper conveyor, and the actuated detent pin protrudes upwardly from the carrier bar relative to the deactuated detent pins. The carrier bar picks up the measured seedling and continues to move it along the grate until the actuated detent pin engages a limit switch 104 positioned above the appropriate gate (see FIGS. 1*a*, 6, and 7). When this occurs, the extended detent pin causes actuation of the limit switch, and the limit switch in turn actuates a solenoid actuated air cylinder 20 to dump the gate for that particular limit switch. In FIG. 1*a*, for example, actuation of limit switch 104*a* causes gate 18*a* to open, dropping the seedling into collector bin 22*a*.

As an alternative to a limit switch, switch 104 could be a proximity switch or other type of switch actuated when an actuator member reaches a predetermined position.

As each seedling is deposited in a collector bin, an electronic pulse counting device 106 counts the number of trees deposited in the bin. After a predetermined number of trees has been deposited in the bin (fifty for example), the bin is dumped onto lower conveyor 24 (as shown by bin 22*e* in FIG. 1*b*). Conveyor 24 can be a conventional belt conveyor and conveys the trees to an appropriate work station where the seedlings can be packaged for shipment.

Referring to FIGS. 6 and 7 for more details of the limit switch actuator or detent pin, each detent pin 102 is an elongated cylindrical member having rounded upper and lower ends, with a flange or spring mounted washer 108 being mounted in a groove in each end of the pin to prevent the pin from sliding all the way through the cylindrical opening 110 in carrier bar 54. Each detent pin has a grooved section 112 on each side of a center portion thereof, such that one groove or the other receives a spring mounted ball 114 when the pin is in its raised or lowered position. Spring 116 urges the ball into the groove to hold the pin in its raised or lowered position until the position is manually changed.

Each gate is provided with its own gate control limit switch assembly 118 comprising a limit switch 104 mounted at an inclined angle (as shown in FIG. 7) on the outer end of a limit switch bracket assembly 120. The limit switch bracket assembly 120 includes a limit switch arm 122 mounted on frame 124 of the apparatus by means of a side mounting plate 126. The outer end of limit switch arm 122 is attached to a limit switch mounting plate 128. Limit switch mounting plate 128 has slotted opening 130 formed therein. The limit switch 104 is attached to the limit switch mounting plate by means of machine screws 132, and the limit switch mounting plate is attached to the end of limit switch arm by means of a hexhead machine screw 134 that fits through opening 130 into a threaded internal opening in the end of arm 122. An alignment plate 136 attached to the outer end of limit switch arm 122 fits under the lower edge of mounting plate 128 and holds the mounting plate and limit switch in a predetermined angular position with respect to the limit switch arm. This permits the limit switch mounting plate to be moved only in a forward or rearward direction so that the precise time at which the limit switch is actuated by the detent pin can be adjusted to correspond to the most appropriate seedling position over the gate.

As shown in FIG. 7, each limit switch 104 has an actuator button 138 which is positioned at an angle and just far enough above the carrier bar so that it will engage an actuated detent pin but will miss a deactuated detent pin. When limit switch 104 is actuated, an actuation signal is transmitted to its corresponding solenoid 20 to open its corresponding gate.

The detent pins are moved downwardly and reset to their deactuated positions by a transverse reset bar 105 positioned at the end of the upper conveyor (see FIG. 1*b*).

The length of limit switch arm 122 is selected to position the limit switch adjacent the detent pin corresponding to that particular gate, the limit switch for each gate occupying a particular transverse location with respect to the conveyor and each carrier bar having a detent pin at that location.

With this apparatus, as soon as the photocell control device registers a seedling of a predetermined height (i.e., in one of five height categories depending upon the number of photocells interrupted), an appropriate detent pin in the upper carrier bar is moved downwardly by one of the solenoid trip levers. The detent pin extends upwardly when the carrier bar reaches the lower portion of the conveyor cycle, and the upwardly extending detent pin actuates a gate limit switch whenever the measured seedling reaches a position over the gate.

A block diagram of the electrical apparatus to accomplish this purpose is shown in FIG. 8. The operation of this circuit is described above and does not appear to require further explanation.

Figure 9:
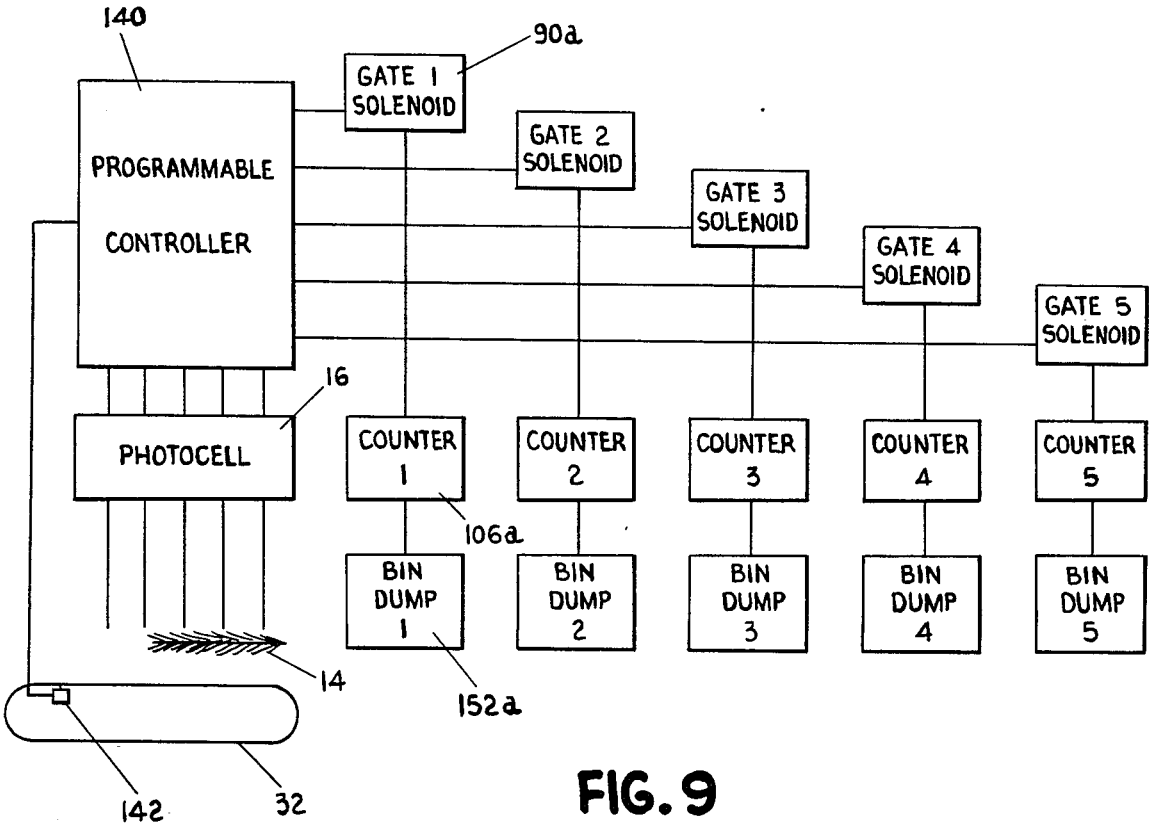
FIG. 9 is another electrical block diagram showing an alternative embodiment of the electrical circuit of the present invention.

Another type of actuation mechanism is shown in FIG. 9. This is an all electronic system and may be preferable to the electro-mechanical system described above. With an electronic photocell control system, the photocell outputs (which represents seedling height) are fed into a programmable controller 140, which is conventionally available. The output of a limit switch 142 (positioned to detect conveyor distance movement by indicating the passage of each link in one of the conveyor chains) also is fed into the controller. The controller is programmed to open the appropriate gate after the seedling has traveled the necessary distance from the photocell device to the gate. At that point, an output signal actuates the appropriate gate solenoid and the gate is opened to dump the seedling into a collector bin. The pulse counter counts the seedlings deposited and dumps the bin when the predetermined number is reached. With this apparatus, the timing is electronic, and the trip solenoids, detent pins, and limit switches can be eliminated.

The mechanism by which the collector bins are dumped is shown in FIG. 3. Collector bins 22 are pivotably mounted between the sidewalls 142 and 144 of the frame by means of pivot shafts 146 and 148. Pivot shaft 148 extends into a globe coupling 150, which is in turn connected to an electrically actuated dump cylinder 152 that is mounted on the outside of wall 144. When the dump cylinder is actuated, the collector bin is pivoted about the axis of shafts 146 and 148.

If the seedling is too small to actuate any of the photocell sensors, none of the gates are opened and the seedling is conveyed to a reject bin 30 (see FIG. 1*b*) at the rear end of the conveyor.

With the present apparatus, the only manual operation is the placing of the seedling on the appropriate ground line at the front end of the machine and the packaging of the appropriately sorted and collected trees at a work station at the end of the machine. The manual sorting and collecting operation has been completely eliminated by the simple and reliable mechanism described above.

It should be understood that the foregoing represents merely a preferred embodiment of the present invention and that various modifications and changes may be made in the details of construction and operation of these embodiments without departing from the spirit and scope of the present invention.

The embodiments of the invention in which an exclusive property or privilege is claimed are defined as follows:

1. A seedling grading machine for sorting and collecting seedling trees according to size comprising:

a transfer conveyor means for conveying the seedlings one at a time along a predetermined path in aligned positions, said transfer conveyor means comprising a longitudinal grate formed of a plurality of spaced parallel bars, the seedlings being positioned transversely across the grate, and carrier means in communication with said grate for moving the seedlings rearwardly on the grate, said carrier means comprising:

lower carrier means positioned below a front portion of the grate for conveying the seedlings from the front toward the back of the grate, the lower carrier means comprising a plurality of equally spaced sets of transversely adjacent carrier rods that are attached to a movable conveyor and extend upwardly through the grate so as to engage and move the seedlings from the front toward the rear of the grate; and upper carrier means positioned adjacent the rear end of the lower conveyor means for continuing the movement of the seedlings along the grate after the end of the front carrier means, the upper carrier means comprising a series of equally spaced sets of transversely adjacent upper carrier rods that are attached to a rearwardly moving conveyor positioned above the grate and spaced at the same intervals as the lower carrier rods, the upper carrier rods extending downwardly to engage and move the seedlings rearwardly on the grate;

electronic photocell control means positioned adjacent the transfer conveyor means for measuring the height of each seedling as it is conveyed along the path, said photocell control means comprising:

photocell means positioned adjacent the grate for measuring the height classification of each seedling and generating an output signal representative thereof;

a plurality of mechanical limit switch actuators mounted on the upper carrier means, the limit switch actuators being formed in sets of individual limit switch actuators spaced transversely across the upper carrier means, with each limit switch actuator corresponding to one size classification and occupying a predetermined transverse position for that size classification, one set of limit switch actuators being provided for each set of carrier rods, the limit switch actuator sets being spaced longitudinally apart along the upper carrier means by the same distance as the carrier rod sets, each limit switch actuator being movable between an actuated and a deactuated position;

electrically actuated trip solenoid means mounted adjacent the upper carrier means for moving the limit switch actuators to their actuated positions, the trip solenoid means comprising a plurality of trip solenoids spaced transversely across the upper carrier means, with one trip solenoid being positioned at the predetermined transverse location for each size classification, the trip solenoid means being responsive to the photocell means such that when the photocell means indicates the presence of a seedling of a given size classification, the trip solenoid corresponding to that size classification is actuated, and such actuation moves the next limit switch actuator in the upper carrier means to its actuated position, the trip solenoid means being positioned such that the carrier rods corresponding to the actuated limit switch actuator will be the carrier rods that convey the particular measured seedling over gates; and switch means for each gate positioned at a transverse location corresponding to the size classification of that gate, the switch means being positioned such that it will be actuated by an actuated limit switch actuator but will not be actuated by a deactuated limit switch actuator, the switch means being positioned such that the corresponding seedling will be positioned over its gate when the switch means is actuated, the switch means actuating a solenoid actuated means to open its corresponding gate when it is actuated;

said gates comprising a plurality of separated gates positioned along the transfer conveyor means downstream of the photocell control means, each gate opening downwardly to let any seedling positioned on the gate to drop downwardly through the conveyor, each gate corresponding to a given seedling size classification and being selectively actuatable by the photocell control means in accordance with the measured height of each seedling, the photocell control means opening the gate corresponding to the measured height of each seedling as the seedling passes over the appropriate gate; and collector means for separately collecting seedlings dropped through each of the gates.

2. A seedling grading machine according to claim 1 wherein the switch means is a limit switch mounted in such a position that it is actuated by engagement with an actuated limit switch actuator, the limit switch returning the limit switch actuator to its deactuated position after the limit switch has been actuated.

3. A seedling grading maching according to claim 1 wherein the carrier rods are mounted on transverse carrier bars that extend across the conveyor and the limit switch actuators are detent pins slidably mounted in openings in the carrier rods for movement in a direction parallel to the carrier rods between deactuated and actuated positions.

* * * * *